US009472089B2

(12) United States Patent
Alhazme

(10) Patent No.: US 9,472,089 B2
(45) Date of Patent: Oct. 18, 2016

(54) METHOD AND SYSTEM FOR MONITORING AND ENFORCING HAND HYGIENE AND SANITIZATION

(71) Applicant: Raed H. Alhazme, Northampton, PA (US)

(72) Inventor: Raed H. Alhazme, Northampton, PA (US)

( * ) Notice: Subject to any disclaimer, the term of this patent is extended or adjusted under 35 U.S.C. 154(b) by 173 days.

(21) Appl. No.: 14/452,000

(22) Filed: Aug. 5, 2014

(65) Prior Publication Data

US 2016/0042634 A1 Feb. 11, 2016

(51) Int. Cl.

*G08B 23/00* (2006.01)
*G08B 21/24* (2006.01)
*G07C 9/00* (2006.01)

(52) U.S. Cl.

CPC ..... *G08B 21/245* (2013.01); *G07C 9/00103* (2013.01); *G07C 9/00111* (2013.01); *G07C 9/00119* (2013.01); *G07C 9/00571* (2013.01)

(58) Field of Classification Search

USPC ..... 340/573.1
See application file for complete search history.

(56) References Cited

U.S. PATENT DOCUMENTS 5,812,059 A * 9/1998 Shaw ..... G08B 21/245 340/539.1
8,482,406 B2 7/2013 Snodgrass
9,000,930 B2 * 4/2015 Pelland ..... G01S 5/02 340/539.13
2006/0272361 A1 * 12/2006 Snodgrass ..... G08B 21/245 68/19
2007/0176774 A1 * 8/2007 Jahrling ..... G07C 3/08 340/539.26
2008/0131332 A1 * 6/2008 Nguyen ..... A61L 2/24 422/119
2008/0136649 A1 * 6/2008 Van De Hey ..... E03C 1/057 340/573.1
2009/0224907 A1 * 9/2009 Sinha ..... G08B 21/245 340/539.11
2009/0265990 A1 * 10/2009 Stratmann ..... A47K 5/12 49/31
2010/0134296 A1 * 6/2010 Hwang ..... A47K 5/1217 340/573.1
2010/0328443 A1 * 12/2010 Lynam ..... G06F 19/327 348/77
2011/0121974 A1 * 5/2011 Tenarvitz ..... G08B 21/245 340/573.1
2011/0206378 A1 * 8/2011 Bolling ..... G08B 21/245 398/108
2013/0187779 A1 7/2013 Pokrajac
2014/0070950 A1 * 3/2014 Snodgrass ..... G06F 19/327 340/573.5

FOREIGN PATENT DOCUMENTS

WO 2013/025889 A1 2/2013

OTHER PUBLICATIONS

HyGreen, HyGreen and Hand Hygiene: How It Works, http://hygreen.com/HandHygieneMonitor/How.asp, 2011.
"UltraClenz, Patient Safeguard System", http://www.ultracienz.com/patient-safeguard-system, May 2014, 1 page.

* cited by examiner

*Primary Examiner* — Naomi Small
(74) *Attorney, Agent, or Firm* — Oblon, McClelland, Maier & Neustadt, L.L.P

(57) ABSTRACT

A method for monitoring hand sanitization policy compliance including initializing a sanitization monitoring sensor (SMS) to a deactivated state, the SMS being configured to wearable by a user, activating the SMS by an SMS activator that is disposed in at least one predetermined location of a structure, wherein the SMS is activated upon a determination of at least one parameter, deactivating the SMS by an SMS deactivator configured to deactivate the SMS upon use of an associated sanitization dispenser by the user, monitoring SMS activation/deactivation activity by a network integrated SMS monitoring module, wherein when the SMS changes activation states, the network integrated SMS monitoring module receives a log of SMS activities, including credentials and time of activation/deactivation; and negotiating access credentials by the SMS with at least one access point wherein the access point restricts access to the SMS if the SMS is activated.

20 Claims, 12 Drawing Sheets

METHOD AND SYSTEM FOR MONITORING AND ENFORCING HAND HYGIENE AND SANITIZATION

BACKGROUND

Grant of Non-Exclusive Right

This application was prepared with financial support from the Saudi Arabian Cultural Mission, and in consideration therefore the present inventor(s) has granted The Kingdom of Saudi Arabia a non-exclusive right to practice the present invention.

FIELD OF THE DISCLOSURE

Description of Related Art

The present disclosure relates generally to systems and methods for monitoring compliance with hand hygiene compliance policies.

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Acquisition of infection by hospital patients and consumers of raw foods is a serious healthcare problem. The Center for Disease Control, the World Health Organization and other health care organizations and agencies encourage healthcare workers to practice proper hand hygiene to reduce the transmission of pathogens via hands. Recommended procedures include the decontamination of the hands prior to direct contact with the patient and/or foods, prior to invasive non-surgical procedures, prior to gloving, after contact with body fluid, mucous membranes, non-intact skin and wound dressings, intact skin and inanimate objects near patients. These procedures apply in hospital settings, doctor's offices, food preparation plants, and anywhere where personnel come into contact with patients or raw foods. It is an aim to reduce the microbe load on the healthcare provider's hands and prevent contamination of either the patients or healthcare providers or the personnel or the consumers of the raw foods.

SUMMARY

In one exemplary embodiment, there is described a method for monitoring hand sanitization practices of personnel and measure compliance with standards that includes initializing a sanitization monitoring sensor (SMS) to a deactivated state configured to be integrated within a personnel's badge or attire, activating the SMS by an SMS activator configured to be placed within regions of a structure, wherein the SMS is activated upon a determination of any of the following conditions: low hand sanitization or contamination, personnel's geographic location within a structure requiring renewed sanitization or a predetermined duration has elapsed since the last sanitization activity, deactivating the SMS by an SMS deactivator configured to deactivate the SMS upon use of an associated sanitization dispenser, monitoring the SMS activation/deactivation activities by a network integrated SMS monitoring module, wherein when the SMS changes activation states, the network integrated SMS monitoring module receives a log of SMS activities, including credentials and time of activation/deactivation and negotiating access credentials by the SMS with at least one access point wherein the access point restricts access to the SMS if the SMS is activated.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
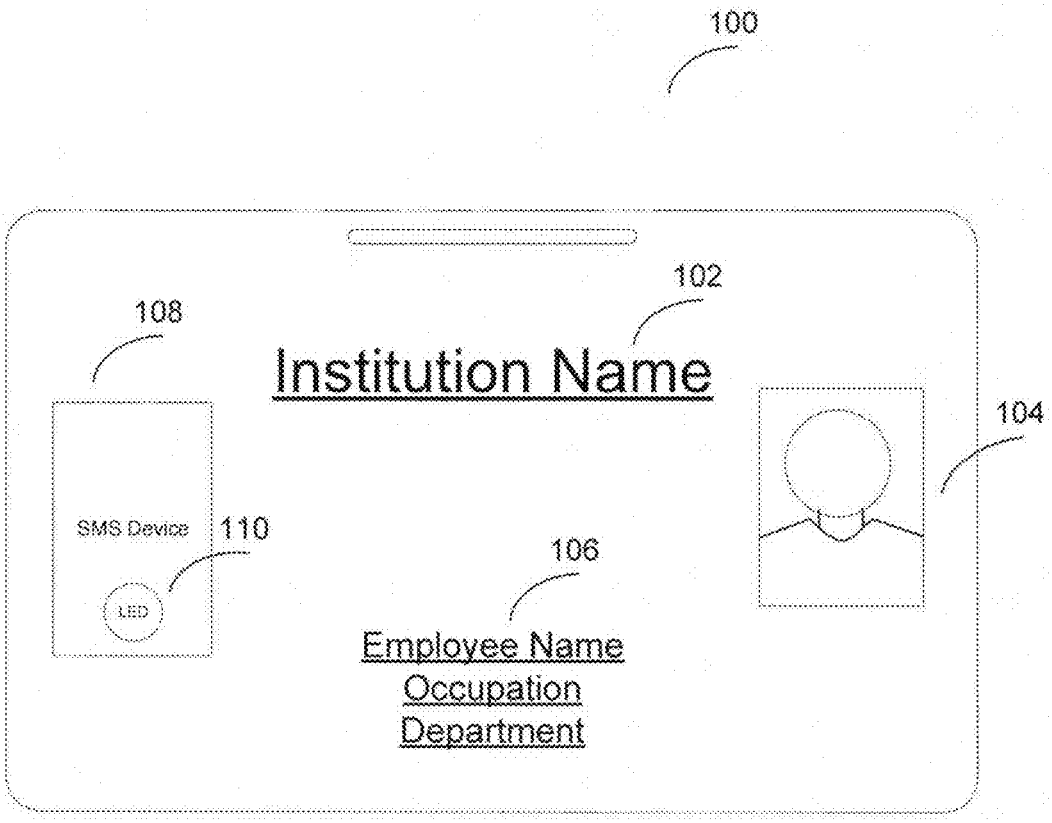
FIG. 1 illustrates an example application of a sanitization monitoring sensor (SMS) device integrated within a personnel's identification badge.

Referring now to the drawings, wherein like reference numerals designate identical or corresponding parts throughout the several views.

FIG. 1 illustrates an example application of a sanitization monitoring sensor (SMS) device integrated within a personnel's identification badge. The personnel can be any personnel associated with required hand hygiene practices, including healthcare professionals and food preparation personnel. While many other personnel and industries would also benefit from the use of the presently disclosed systems and methods, a focus on healthcare professionals and applicable exemplary embodiments will be further explored as a representative application.

FIG. 1 includes a personnel badge 100 that may include the name of the institution for which the healthcare professional works 102, an identification picture of the healthcare professional 104, and name, occupation and department of the healthcare professional 106. Personnel badge 100 also includes an integrated sanitization monitoring sensor (SMS) device 108. SMS device 108 may be integrated within any personnel badge, or alternatively, it may also be implemented within many different items used by the healthcare professional, including but not limited to clothing attire, such as white coat or the like. SMS device 108 also includes a visible light emitting diode (LED) 110 that can be configured to present different visual signals to indicate state status of SMS device 108. For example, LED 110 may be set to OFF, BLINKING or ON modes to portray different SMS device activation states. In one example, OFF would indicate visually that the SMS device is deactivated. BLINKING may illustrate that the SMS device is activated but access restriction protocol is not yet implemented. Alternatively, ON may illustrate that the SMS device is activated and access restriction protocol is applied such that the healthcare profession can no longer use the badge to access specific zones of a building.

Figure 2:
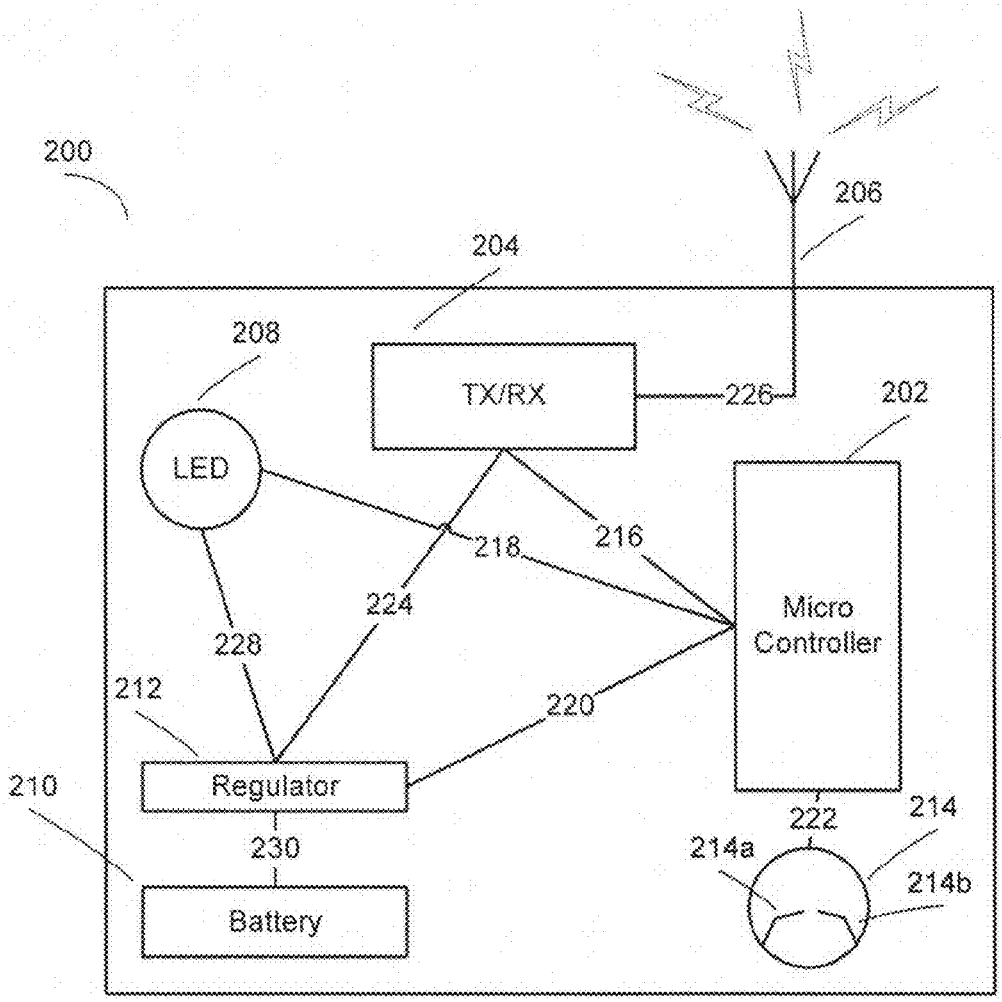
FIG. 2 illustrates a schematic layout of the internal components of the SMS device according to one embodiment.

FIG. 2 illustrates a schematic layout of the internal components of the SMS device according to one embodiment. In one exemplary embodiment, SMS device 200 includes a microprocessor 202, a transmitter/receiver (transceiver) 204, an antenna 206, an LED 208, a battery 210, a battery regulator 212, and a touch sensor 214. Microprocessor 202 is configured to communicate with transceiver 204 via link 216, with LED 208 via link 218, with battery regulator 212 via link 220 and touch sensor 214 via link 222. Transceiver 204 is configured to communicate with antenna 206 via link 226 and with battery regulator 212 via link 224. LED 208 is configured to communicate with battery regulator 212 via link 228 and battery 210 is configured to communicate with battery regulator 212 via link 230.

Microcontroller 202 may be any type of microcontroller designed to process information, commands, and store information related to the healthcare personnel. For example, microcontroller 202 may be an 8-bit simple microcontroller that can store up to 65 kilo-bits (KB) of information. In one exemplary embodiment, the microcontroller may be configured to be initialized in a deactivated state or in the alternative initialized to an activated state. When activated, microcontroller 202 sends a signal to LED 208 to enter a BLINKING or ON mode and when deactivated, microcontroller 202 sends a signal to LED 208 to remain in OFF mode. Transceiver 204 is configured to transmit and receive status signals between SMS device 200 and other modules within the system. Other modules may include an SMS device activator, SMS device deactivator, and a central network module configured to collect activation/deactivation information of SMS device 200. Transceiver 204 may be configured to operate in compatibility with a wide array of communication technologies, including, but not limited to, radio frequency (RF) technologies, Infrared (IR) technologies, Bluetooth technologies, Wi-Fi technologies, and any other wireless and/or optical technologies that may be implemented. To conserve battery life, microcontroller 202 may enter a sleep mode when SMS device 200 is deactivated and turn on when SMS device 200 is activated. This would allow microcontroller to conserve battery life as it will be turned on only when activated, and in other scenarios, it will be in a sleep mode awaiting a wake-up or interrupt signal from an SMS activator.

According to one exemplary embodiment, there may be an integrated deactivator device within SMS device 200. Touch sensor 214 may be implemented to act as an SMS device deactivator. For ease of use, or in instances where battery may be low or communication systems are ineffectively operable, touch sensor 214 may be utilized. Touch sensor 214 may include several design implementations. In one exemplary implementation, touch sensor 214 includes two terminals, 214*a* and 214*b*. In normal settings, there is an open space between terminals 214*a* and 214*b* to cause an open circuit effect. In order for the sensor to send a signal to microcontroller 214, the gap between the terminals would need to be closed. In an exemplary embodiment, the gap may be closed by placing a sanitized finger on the sensor 214. In typical fashion, a dry finger is not sufficiently conductive in order to close the circuit. Instead, upon sanitization of the hand, for example, applying dispensed alcohol onto the hand/fingers, a finger with sanitization liquid on it would be sufficiently conductive as to close the loop between terminals 214*a* and 214*b*. When the loop is closed, a signal is sent to microcontroller 202 to amount to a deactivation signal. Upon receipt of the deactivation signal from sensor 214, microcontroller 202 would turn OFF LED 208 and enter sleep mode awaiting the next wake-up/interrupt. Alternatively, a sanitizing liquid with a saline component, with relatively high conductivity, may be used as the cleaning liquid.

Figure 3:
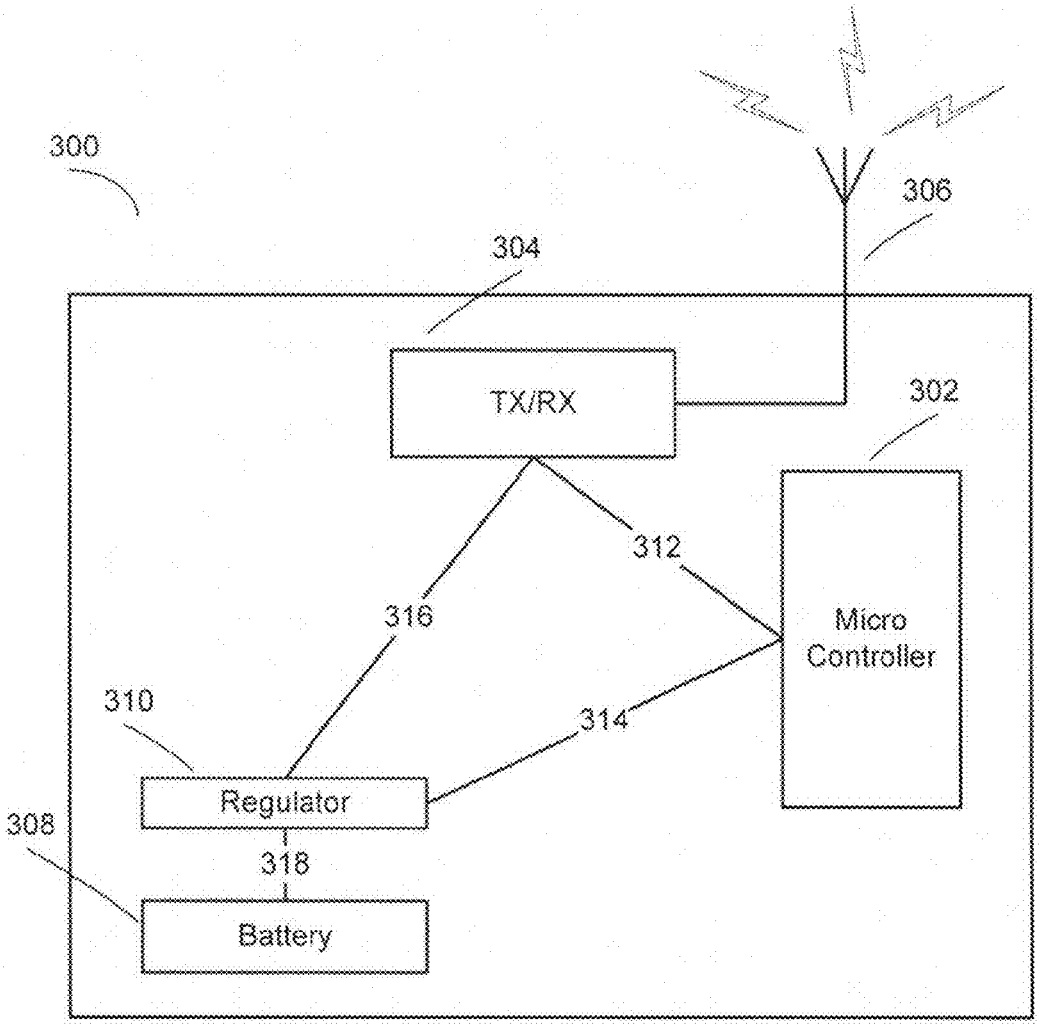
FIG. 3 illustrates a schematic layout of the internal components of an SMS activator according to one embodiment.

FIG. 3 illustrates a schematic layout of the internal components of an SMS activator 300 according to one embodiment. SMS activator 300 may be configured to include microprocessor 302, transceiver 304, antenna 306, battery 308 and regulator 310. Microcontroller 302 communicates with transceiver 304 via link 312 and draws power from regulator 310 via link 314. Transceiver 304 draws power from regulator 310 through link 316 and the battery is connected to the regulator via link 318. SMS activator 300 can be placed in many different locations throughout a structure such as a building or a hospital or a doctor's office or a food preparation plant.

One location is outside of a bathroom such that if a user wearing a device 200 walks into the bathroom, the device 200 will be activated when the device 200 is brought next to the activator 300 when the user comes out of the bathroom and the device 200 includes a saved data file indicating that it was recently (e.g. within 60 seconds) was deactivated, then device 200 will ignore the activator 300 and remains in a deactivated state.

SMS activator 300 may be secured or affixed to a wall or may be on a standalone structure, thus making it more mobile. If affixed to a wall or structure, SMS activator 300 may utilize the building's main power supply as a power source to transmit activation signals. In the alternative, SMS activator 300 may use battery power to generate activation signals and run the internal components.

In one exemplary embodiment, both, SMS device 200 and SMS activator 300 may use a combination of frequency ranges to reduce power consumption and conduct hand shaking protocol. For example, SMS activator 300 may be implemented in such a manner to send periodic activation broadcast signals within its vicinity. The broadcast signals may be wakeup signals designed to wake up an SMS device 200 and take it out of a sleep mode. It would be useful to use low frequency ranges for the wakeup signals because it allows microcontroller (both microcontroller 202 and 302) to remain in a low power sleep state until needed. This can help extend the life of the battery. Given that the SMS device 200 operates as a mobile device that is worn by a user, it would be advantageous to have the SMS device 200 and activator 300 to be light and compact as possible. In one example, the use of the low frequency ranges allows for the transceiver 204 to draw little power and detect signals transmitted from transceiver 304. When the wakeup signal broadcast sent by SMS activator 300 is received by SMS device 200, transceiver 204 activates an input on microcontroller 202 which is preprogrammed to cause the microcontroller to wake up from low power sleep state. When awakened, microcontroller 202 of SMS device 200 may read any activation broadcast messages received from SMS activator 300.

In yet another embodiment, SMS device 200 may also broadcast its identification information when awakened. For example, when a wakeup broadcast signal is received from the SMS activator 300, SMS device 200 may then broadcast its identification information, including activation/deactivation patterns, user identification, battery power level and other parameters to SMS activator 300 for future manipulation. In one embodiment that any and/or each of the microcontrollers 202, 302 and 402 (to be further discussed below) have the capability to store activation/deactivation and identification information and have the capability to relay such in to a requesting device. Requesting devices could include an SMS activator, and SMS deactivator, or a central network module configured to ping and retrieve such information from SMS related devices via a communication protocol such as Bluetooth or Wi-Fi or RF.

Figure 4A:
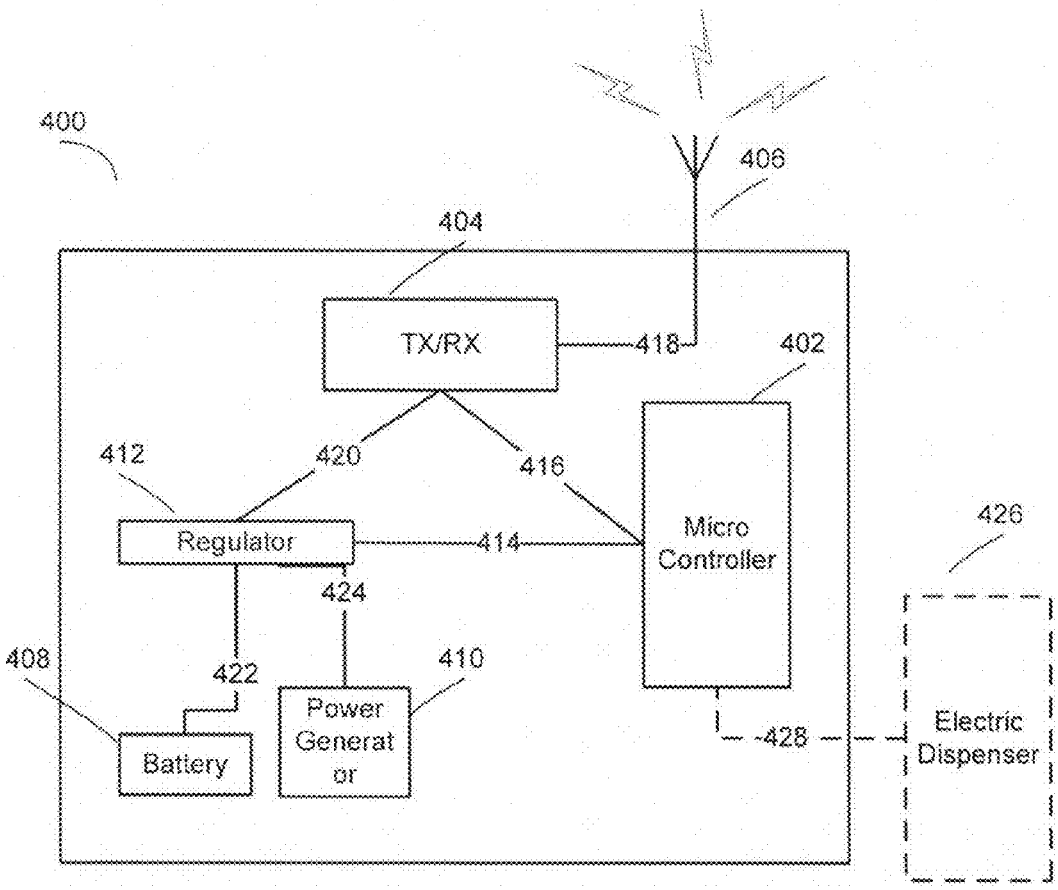
FIG. 4*a* illustrates a schematic layout of the internal components of an SMS deactivator according to one embodiment.

FIG. 4*a* illustrates a schematic layout of the internal components of an SMS deactivator 400 according to one embodiment. In one exemplary embodiment, SMS deactivator 400 includes microcontroller 402, transceiver 404, antenna 406, battery 408, power generator 410 and regulator 412. Microcontroller 402 is configured to communicate with transceiver 404 through link 416 and power regulator 412 via link 414. Transceiver 404 communicates with antenna 406 via link 418 and with power regulator via link 420. Battery 408 and power generator 410 supply power to power regulator via links 422 and 424 respectively. SMS deactivator 400 may also be placed within different areas of a hospital or doctor's offices. For example, they may be placed within corridors, at entrances of rooms, buildings and zones, or even next to or within close proximity to SMS activators. SMS deactivator 400 may also be placed within sanitization dispensing units, such as electric dispenser 426 that may be connected directly to the microcontroller or may also transmit a specific signal to transceiver 404 to request the broadcast of a deactivation signal. Alternatively, SMS deactivator 400 may also be placed within mechanical dispensers 430, as those shown in FIGS. 4*b* and 4*c*. Mechanical dispensers include a power generator to generate power signal and coded signal to microcontroller 402 informing it that the dispenser has been used and for transceiver 404 to transmit a deactivation signal broadcast.

The primary object and use of SMS deactivator is to deactivate the SMS device 200 and return its processor 204 into a sleep mode. To do so, deactivator 400 may transmit a deactivation signal broadcast when it is used to the proximate vicinity. For example, it may transmit a deactivation signal to a radius of 1-3 feet to allow for the deactivation of intended healthcare professional and not all potentially active SMS devices in a room. Although uniquely assigned signals may be receivable by particular SMS devices.

There are multiple ways in which deactivator 400 may be triggered to produce a deactivation broadcast signal. Given the objective of maintaining high hygiene standards, one preferred embodiment would allow deactivator 400 to broadcast a deactivation signal when a sanitization dispenser is used. Sanitization dispensers can be mechanical or electrical in nature. In one such example, SMS deactivator 400 may be placed within an electrical sanitization dispenser, such as electric dispenser 426 such that when the dispenser dispenses a sanitization substance, SMS deactivator transmits a deactivation broadcast signal. When electric dispenser 426 dispenses sanitization substance, a command is transmitted to microcontroller 402, either wirelessly (to be processed through antenna 406 and transceiver 404) or directly through link 428 to transmit a deactivation broadcast signal. As mentioned earlier, broadcast signals are intended to have limited radius of transmission as to not mistakenly deactivate any activated SMS devices belonging to healthcare professionals not using the sanitization dispenser.

Figure 4B:
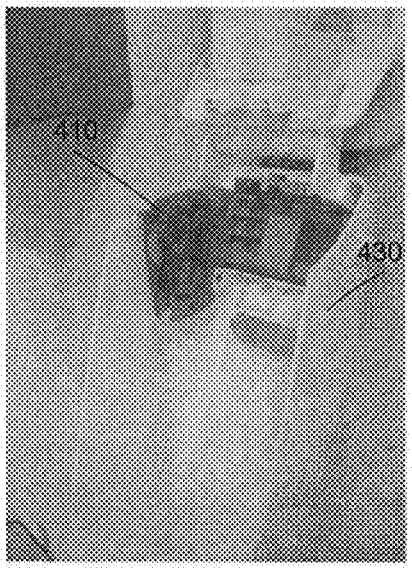
FIG. 4*b* illustrates one implementation of the SMS deactivator within a sanitization dispenser using a mechanical power generator to generate a deactivation signal according one embodiment.

FIG. 4*b* illustrates one implementation of the SMS deactivator 400 within a sanitization dispenser using a mechanical power generator to generate a deactivation signal according to one embodiment. Sanitization dispenser 430 is configured to house SMS deactivator 400 within its structure as to make it simpler to allow sanitization dispenser to electronically or mechanically communicate with SMS deactivator 400. In one such example, power generator 410 is shown to be implemented as part of sanitization dispenser 430 and is configured to be directly connected to the push lever of sanitization dispenser 430 to create the mechanical power generation.

Figure 4C:
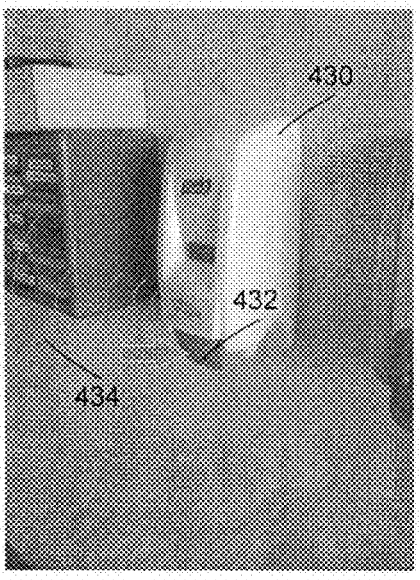
FIG. 4*c* illustrates one implementation of the SMS deactivator within a sanitization dispenser using a mechanical power generator to generate a deactivation signal according to one embodiment.

FIG. 4*c* illustrates one exemplary implementation of the SMS deactivator 400 within sanitization dispenser 430 using a mechanical power generator to generate a deactivation signal according to one embodiment. In this example, sanitization dispenser 430 is a mechanical device that dispenses sanitization material whenever mechanical arm 432 is actuated. In such a case, when lever 432 is pushed or actuated, power generator 410 is activated, causing it to transform mechanical motion into an electrical signal sufficient to power microcontroller 402 to transmit deactivation broadcast signal 434. As can be illustrated in this example, deactivation broadcast signal 434 is transmitted within a short distance intended to deactivate only an SMS device 400 of the healthcare professional using the sanitization dispenser. Any and all microcontrollers in the system, such as microcontroller 202, 302 or 402 may be configured to house and store activation/deactivation and SMS device identification information for later retrieval by a central network module. Furthermore, all transceivers 204, 304 and 404 may be configured to operate and interact using one or several communication technologies, including but not limited to, IR, RF, Bluetooth, cellular network and Wi-Fi.

Figure 5:
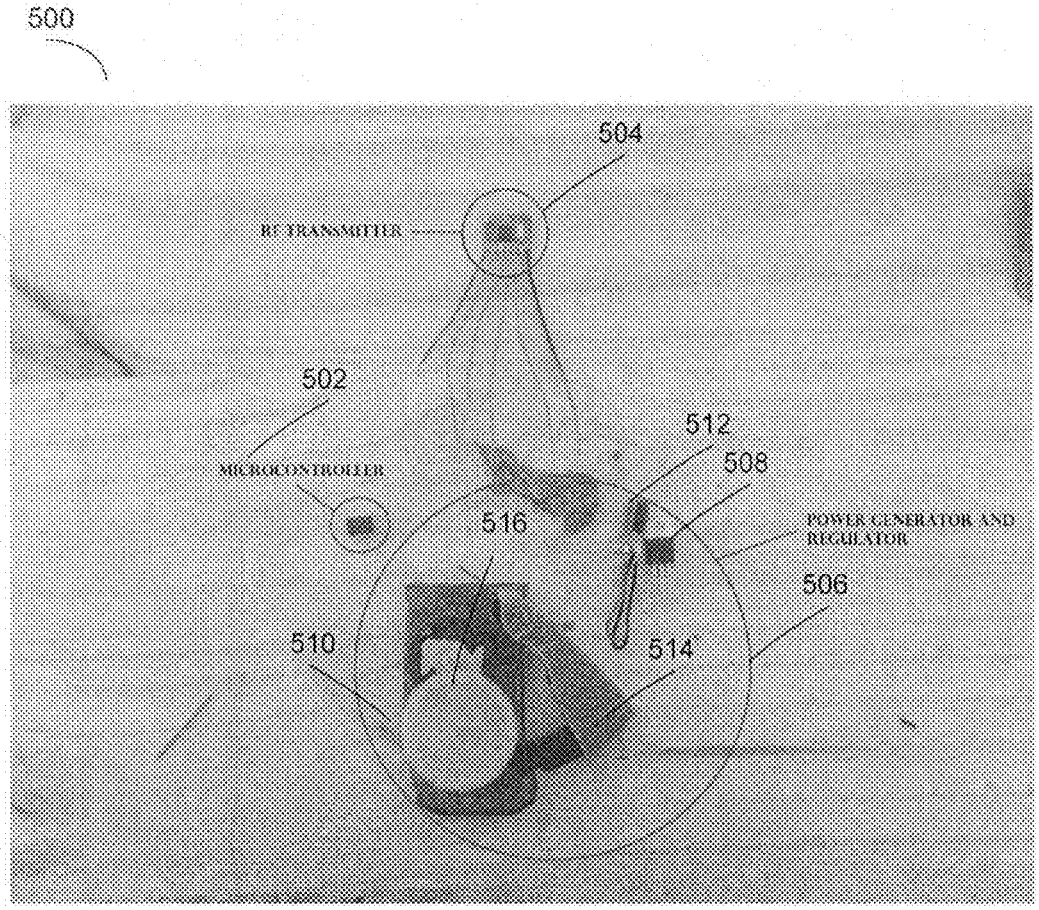
FIG. 5 illustrates another implementation of the SMS deactivator including a mechanical power generator.

FIG. 5 illustrates another exemplary implementation of the SMS deactivator 500 including a mechanical power generator 510. SMS deactivator 500 includes microcontroller 502, RF transmitter 504, power generator and regulator 506, potentiometer 508, power generator 510 and capacitor 512. Both the potentiometer and the capacitor are used to mitigate the power regulation mechanism necessary to regulate the amount of power transmitted to each and every component of SMS deactivator 500. Power generator 510 can be mechanically actuated in such a manner as to allow a pressing motion on lever 514 to rotate gear 516 to generate electric power that is later transmitted to microcontroller 502. Microcontroller 502 can be any type of controller, including an 8-bit microcontroller capable of storing 65 KB or more of data related to activation and deactivation of SMS devices and other instructions.

Figure 6:
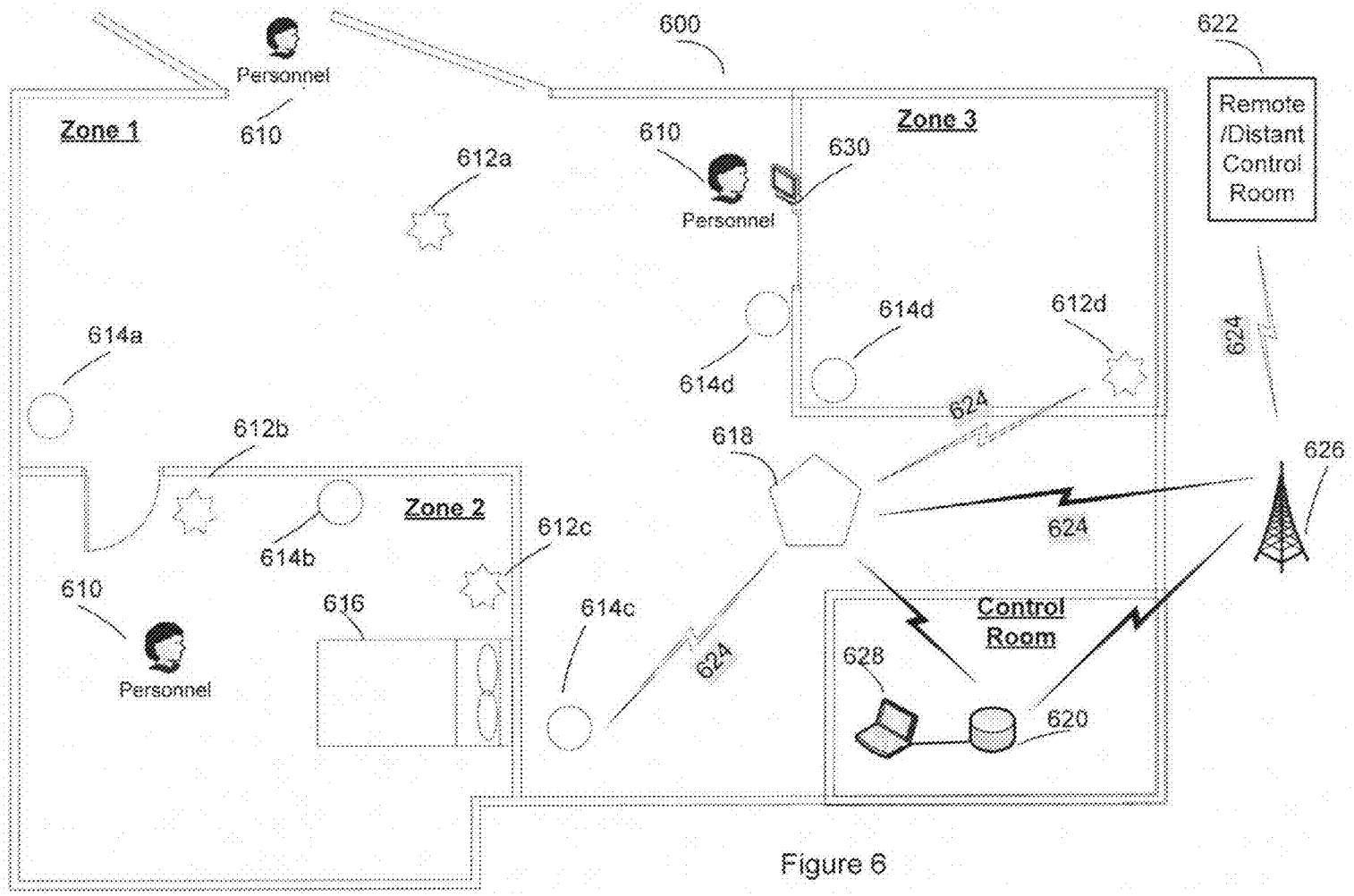
FIG. 6 illustrates a configuration of a work space/hospital that is segmented into zones used to activate and deactivate personnel SMS devices.

FIG. 6 illustrates an exemplary configuration of a work space/hospital 600 that is segmented into zones used to activate and deactivate personnel SMS devices. In an exemplary embodiment, work space 600 may be a hospital floor, or doctor's office or a food preparation facility with many different rooms, corridors and access points. Work space 600 includes several SMS activators (as represented by activators 612*a* . . . 612*n*) wherein n>1 and SMS deactivators (as represented by deactivators 614*a* . . . 614*n*) dispersed throughout works space 600. Work space 600 may be divided into multiple zones (in a hospital these can be general public spaces, staff quarters, nurse's stations, and patient rooms). In this example, work space 600 may be divided into 3 zones (zone 1, zone 2 and zone 3) such that zone 1 may depict a general public area or a waiting area or a staff or nursing area, zones 2 and 3 indicate more restricted areas, such as operating rooms, intensive care units (ICU), or patient rooms.

There may be multiple configurations to allow for activation/deactivation of personnel's SMS device (assumed to be on personnel at all times and integrated in the form of a badge or within personnel's professional attire). In one exemplary embodiment, there may be a zone wide activation scheme such that personnel entering into and out of a specific zone have their SMS devices automatically activated. In yet another exemplary embodiment, there may be a sub zone activation mechanism such that activators are placed within a specific zone to encourage sanitization coming in and leaving the zone or activators placed near patients or sensitive areas such that as personnel approach an area of interest (such as a patient's bed, restroom, etc.), they may have their SMS device activated.

In one example, personnel 610 enters zone 1 with a deactivated SMS device. Upon entering zone 1, personnel 610 have his/her SMS device activated by SMS activator 612*a*. Activation here can be done in several ways. One such way includes a general broadcast signal transmitted periodically by SMS activator 612*a* as a wakeup signal to any and all SMS devices that are entering zone 1. Once the SMS device wakes up and turns on, a handshake takes place where SMS device transmits its information and activation status to activator 612*a*. Upon receiving the SMS device information, SMS activator may transmits activation signal to SMS device. SMS device thereafter receives the activation signal and changes its status to activated and turns ON the LED light. LED light may be turned to BLINKING status if it has been activated for a first time. Such an activated status may indicate that the SMS device is activated for a first time and may still have potential access to given areas, such as common areas, nurse's stations, etc. If it is determined that the SMS device is being activated for a second time, e.g. activating an already activated SMS device, then the LED light is turned on and the status state of SMS device will change from BLINKING to ON. In such a case, access may be completely restricted for the SMS device until the personnel associated with the SMS devices deactivates the device. This may be the case if personnel 610 is activated by activator 612*a* and fails to sanitize as he/she enters zone 2. In this scenario, SMS device will turn from BLINKING to ON and a warning may be issued to the medical professional via text message or vibration or sound. This may be the case in rooms that do not require access restrictions such as zone 2.

In yet another example, assuming personnel 610 sanitizes his/her hands at deactivator 614*a*, and wishes to enter zone 2, his/her SMS device is now deactivated and the LED light is turned off. If the zone activation procedure is implemented, then upon entering zone 2, personnel 610's SMS device will be activated by SMS activator 612*b* and will be required to sanitize at deactivator 614*b*. If the local activation procedure is implemented, then personnel 610's SMS device would not be activated until he is within close proximity to patient bed 616, at which point personnel 610 will need to use sanitization dispenser and deactivator 614*b* to sanitize his hands before further proceeding with the patient.

The collection of activation/deactivation information of personnel is vital to monitoring and keeping track of who adheres to institutional guidelines and policies and who does not. Based on such information, incentive or warning schemes may be devised to address the conduct. As mentioned earlier, each device within the system includes a microprocessor (such as microprocessor 202, 302 or 402) that is capable of storing identification and activation/deactivation information, including times, and locations of activation/deactivation events. As such, the activation/deactivation information may be retrieved by any or all of the devices in the system. In one exemplary embodiment, an SMS device may be configured to store all information related to each and every activation/deactivation event, the identification number of each activator and deactivator device, location of the devices, and the time stamp that the activation/deactivation event occurred. For example, when personnel 610's SMS device is activated by activator 612*a* and then deactivated by deactivator 614*a*, a log is maintained within SMS device's memory (not shown) as well as stored in memories within microprocessors of other modules within the network such as activators and deactivators.

To compile a log of SMS device activation/deactivation events, a central network module 618 is utilized to extract that information. In one embodiment, central network module 618 may be distributed throughout work space 600 such that whenever personnel 610 is within close proximity with central network module 618, a handshake procedure is performed to transmit the information from SMS device to central network module 618. The handshake may be performed using different technologies, including RF, IR, Wi-Fi and Bluetooth technologies. In one example, central network module 618 may send a ping message broadcast to be answered by any SMS device within its proximity Upon receiving a ping, an SMS device may be programmed to transmit log files of all activation/deactivation information for a given period of time to central network module 618. The given period of time may be a number of hours, days or weeks.

In another exemplary embodiment, central network module 618 may transmit a request for log information to all devices within a given zone. For example, central network module 618 may periodically ping all devices within its zone, such as zone 1, to transmit log files of activation/deactivation status and times and identification of the devices. To reduce redundancies, central network module 618 can ping only SMS devices within zone 1 to transmit log information. In an alternative embodiment, central network module 618 may ping all devices within zone 1 and compile a log file for each and every device, including SMS devices, activators and deactivators. This can be helpful in the activation/deactivation status of each SMS device, but also, which activator/deactivator is frequently used, battery status, and any maintenance related issues.

In yet another embodiment, central network module may be configured to be connected to a network along with other devices, such as activator 612*a*, deactivator 614*a* and SMS device on personnel 610. The network can be any type of internet, intranet, cloud, or cellular network used to connect the devices. Using Wi-Fi technology, central network module 618 may also ping all devices on the network to transmit activation/deactivation log information. For example, central network module 618 may transmit a wakeup signal 624 to initialize communication with activator 612*d*. Activator 612*d* in tern transmits stored log information to central network module 618 irrespective of whether central network module is in the same zone, or on the same floor or within pinging region of central network module 618's RF capabilities. This may further reduce potential redundancies in deployment of central network modules across zones.

After collecting all information from the devices within its zone, floor, RF reach or network, central network module 618 transmits compiled log files to a network database 620. Network database 620 may be located in a local control room or remote control room 622. Remote control room 622 can be within the same building or any other remote location such as a corporate office. Communication with network database 620 may be carried out using any communication technology, including but not limited to RF, IR, Bluetooth, Wi-Fi, and also any type of direct hard line connection, such as Ethernet, cable, or the like. To communicate with a network database 620 located in a distant control room; communication may be carried out via internet or cellular networks as represented by network 626. In order to extract the log data and manipulate the information to generate reports associated with personnel hygiene habits, and issue incentive programs, a programmed computer device 628 is connected to network database 620. Programmed computer device 628 may also connect to network database 620 directly via wired connection, or wirelessly from any location using a wide array of wireless protocols, such as RF, Bluetooth and Wi-Fi technologies that enable internet and network access.

Programmed computer device 628 may be configured to develop activation/deactivation log charts that include a wide array of applications, including indicating activation and deactivation times for each personnel 610, hygiene habits, length of activation times of SMS devices associated with personnel 610, and violations of the required procedures. Additionally, programmed computer device by further develop charts that include most used activators and deactivators, battery life, maintenance and sanitizer levels related issues.

In yet another example, programmed computer device 628 may be a networked device such that it can restrict access credentials for personnel 610. For example, upon retrieving the log files and producing charts for personnel 610, programmed computer device 628 may determine that personnel 610 is a constant violator of the rules and further determine to restrict access credentials at access point 630 to not allow personnel 610 to access zone 3. This can be followed by requiring personnel 610 to see an administrator and further discuss hygiene related procedures. Alternatively, depending on the frequency of the generated reporting submitted to programmed computer device 628, it may grant and restrict access on a system wide real time basis. For example, programmed computer device 628 may be receiving log files from database 620 on a frequent basis, for example, on multiple intervals within a minute, then programmed computer device 628 can restrict access credentials to SMS device associated with personnel 610 and may not allow him/her to access zone 3 via access terminal 630 until he/she deactivates his/her SMS device by using deactivator 614*d*.

Figure 7:
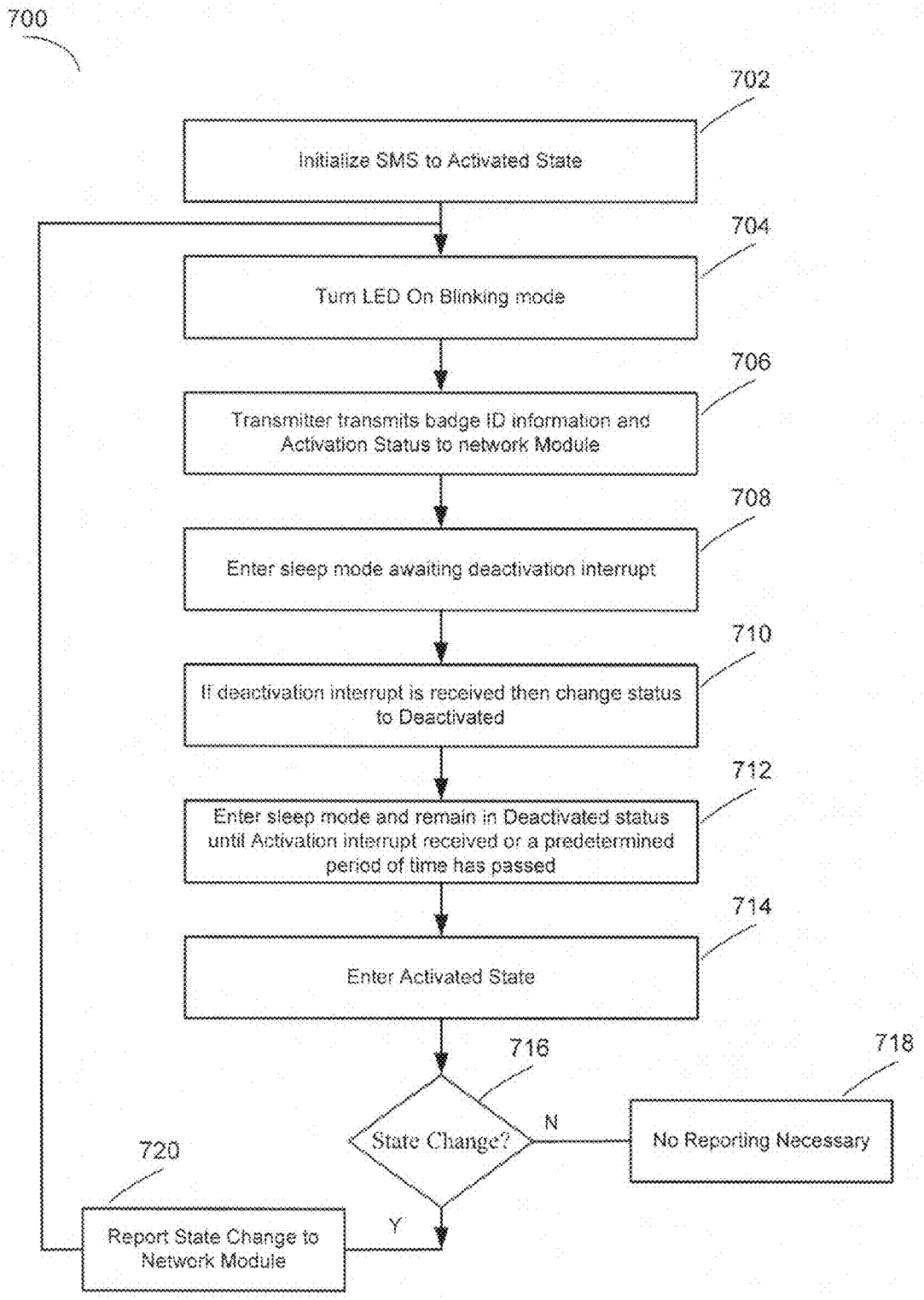
FIG. 7 is a flow diagram of an implementation of the activation/deactivation method when an SMS device is initialized to an activated state.

FIG. 7 is a flow diagram of an exemplary implementation of the activation/deactivation method 700 when an SMS device is initialized to an activated state. As an initial step, the SMS device may be initialized to an activated state. Initialization may be mechanical or motion sensitive. In one example, there may be a physical turn on and off switch that initializes the SMS device when healthcare professional or personnel uses the badge. In another example, SMS device may be motion sensitive such that it may initialize when it detects motion after long period of time of being still. For example, if SMS device is in sleep mode for a given period of time, then SMS device may be alerted that it is no longer in use, e.g. being placed on table, locker, or hung with coat for the day as personnel leave work, take a break, etc. When alerted of a period of non-use, SMS device enters sleep mode and may be woken up by detection of motion. For example, if SMS device is left unmoved for the night, it enters sleep mode awaiting initialization. Upon picking it up again, the SMS device detects motion and enters initialization phase, such as being initialized to an activated state. When activated, SMS device automatically turns 704 the LED to either ON or BLINKING states. BLINKING and ON could mean the same state or alternatively could mean different states. For example, BLINKING could indicate that SMS device is indicating a low grade level of contamination and sanitization may be optional, or indicate that sanitization is recommended at this time rather than required. ON could indicate that SMS device is indicating high grade level of contamination and that sanitization is required. Alternatively, BLINKING could indicate that SMS device is indicating contamination but access to specific zones is not restricted, wherein ON indicates that access at all access terminals leading to specific zone are now restricted pending further sanitization procedures.

In one exemplary embodiment, SMS device may be programmed to transmit 706 SMS device and badge identification information to central network module to record its activation status upon initialization. In another embodiment, if SMS device is not wirelessly connected to central network module or internet, it may directly enter sleep mode 708 and await a deactivation interrupt received from a deactivator. When a deactivation interrupt is received 710, SMS device may change status to deactivated. Here once again, SMS device may transmit status change or may enter sleep mode once again 712 and remain in deactivated status until an activation interrupt is received. In an alternative embodiment, SMS device may be programmed to count a predetermined amount of time before entering a sleep mode or entering an activated state. For example, if a personnel uses a sanitization device such that a deactivator sends a signal to deactivate the SMS device, the SMS device will be deactivated. If however, the personnel continues to be mobile and within the hospital or building setting, then it is assumed that the personnel is still working and has passed a specific time threshold without sanitizing once again. In this case, SMS device determines that it should enter activated state once again to alert the personnel that a sufficient time has elapsed in which their hands are no longer considered sanitized and the personnel should sanitize once again. When entering activated state 714, SMS device determines whether there has been a state change or not. If no state change occurs, then SMS device may not report 718 any state changes to the central network module. Alternatively, if there is a state change then SMS device would report state change 720 to central network module and again turn the LED to ON or BLINKING. In all cases, SMS device maintains a log of activation and deactivation times, places, and duration and can transmit them upon enquiry by any other device in the system, including central network module, activator and deactivator devices.

Figure 8:
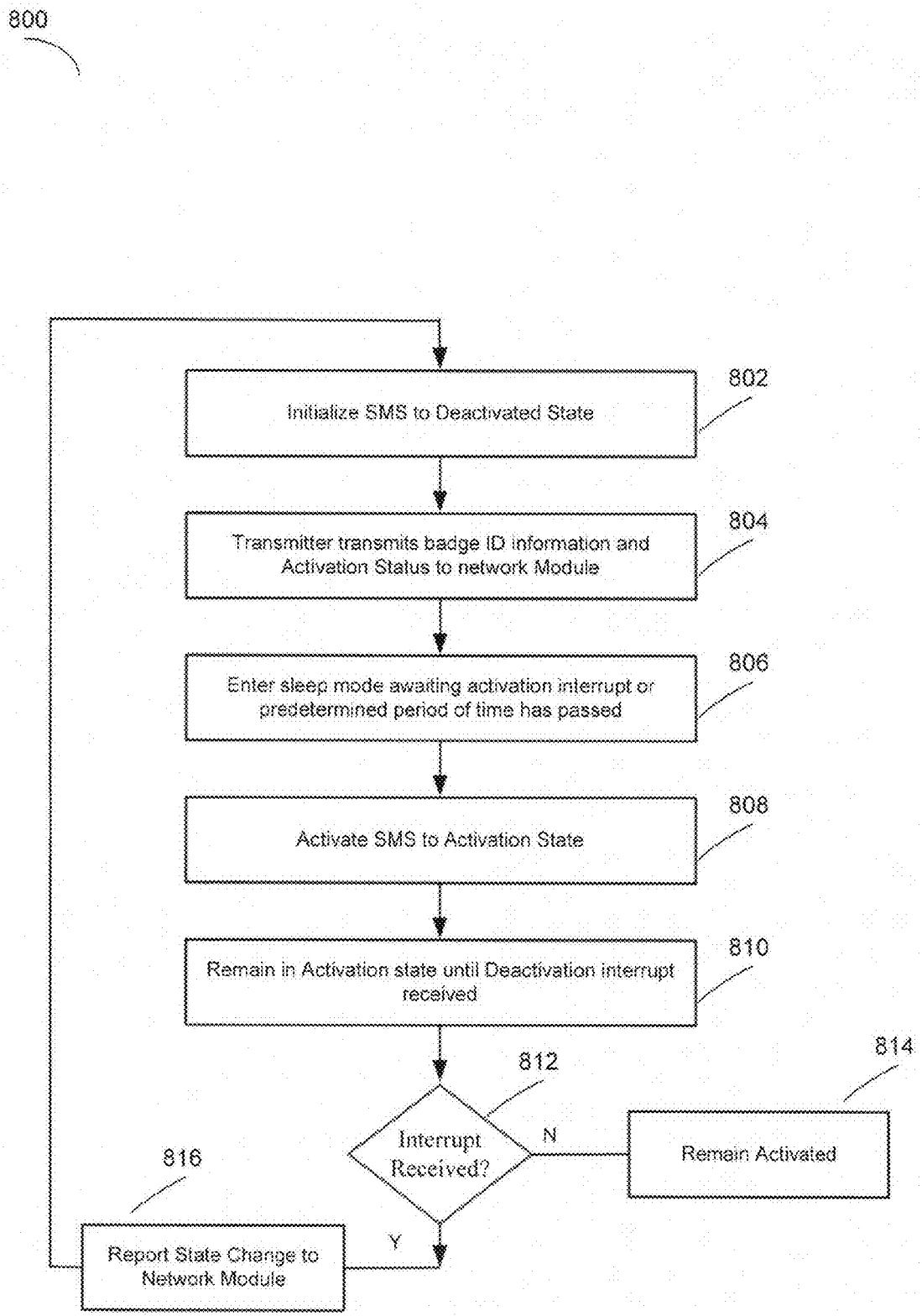
FIG. 8 is a flow diagram of an implementation of the activation/deactivation method when an SMS device is initialized to a deactivated state.

FIG. 8 is a flow diagram of an exemplary implementation of the activation/deactivation method 800 when an SMS device is initialized to a deactivated state. As an initial step, the SMS device may be initialized to a deactivated state. Initialization may be mechanical or motion sensitive. In one example, there may be a physical turn on and off switch that initializes the SMS device when healthcare professional or personnel uses the badge. In another example, SMS device may be motion sensitive such that it may initialize when it detects motion after long period of time of being still. For example, if SMS device is in sleep mode for longer period of time than a given period of time, then SMS device may be alerted that it is no longer in use, e.g. being placed on table, locker, or hung with coat for the day as personnel leave work, take a break, etc. When alerted of a period of non-use, SMS device enters sleep mode and may be woken up by detection of motion. For example, if SMS device is left unmoved for the night, it enters sleep mode awaiting initialization. Upon picking it up again, the SMS device detects motion and enters initialization phase, such as being initialized 802 to a deactivated state.

In one exemplary embodiment, SMS device may be programmed to transmit 804 SMS device and badge identification information to central network module to record its activation status upon initialization. In another embodiment, if SMS device is not wirelessly connected to central network module or internet, it may directly enter sleep mode 806 and await an activation interrupt received from an activator or wait for a predetermined period of time before automatically activating 808. Adhering to the hygienic principles of the system, SMS device may be activated externally by an activator, when personnel walks by an activator or enters a new zone. Alternatively, SMS device may also self-activate if a predetermined period of time has elapsed without a recorded activation/deactivation event. This enables the system to further ensure that personnel hands and hygiene practices are kept at optimal levels. In some instances, personnel may remain within a specific area or zone for prolonged periods of times, as such; they may not come in close proximity with an activator or may not leave a zone for prolonged periods of time. Automatic activation can be utilized to ensure a minimum standard to such personnel as well, wherein at least a minimum number of sanitization events should occur within a given time period, such as an hour, few hours, day, etc.

The SMS device may remain 810 in activated state until a deactivation interrupt is received. A determination thereafter can be made as to whether an interrupt is received 812. If it is received, then a state change may be reported to central network module if the SMS device is connected to the network. In all cases, the SMS device maintains a log of all activation/deactivation information and may be quarried when it connects to central network module via other wireless technologies. If an interrupt is not received, the SMS device will remain in activated mode 814. If BLINKING is utilized as an intermediary contamination level, then prolonged activation periods could result in the LED changing from BLINKING to ON states. In such cases, ON indicates that the SMS device has lost access privileges and no longer has access to specific zones within a building. This may be communicated to a central network station wherein repudiating access credentials is done at a central location, or it can be done at an access point such that access is denied when an access point negotiates with an activated SMS device. In one exemplary embodiment, regardless of the level of activation of SMS device, e.g. BLINKING or ON, access may be restricted.

Figure 9:
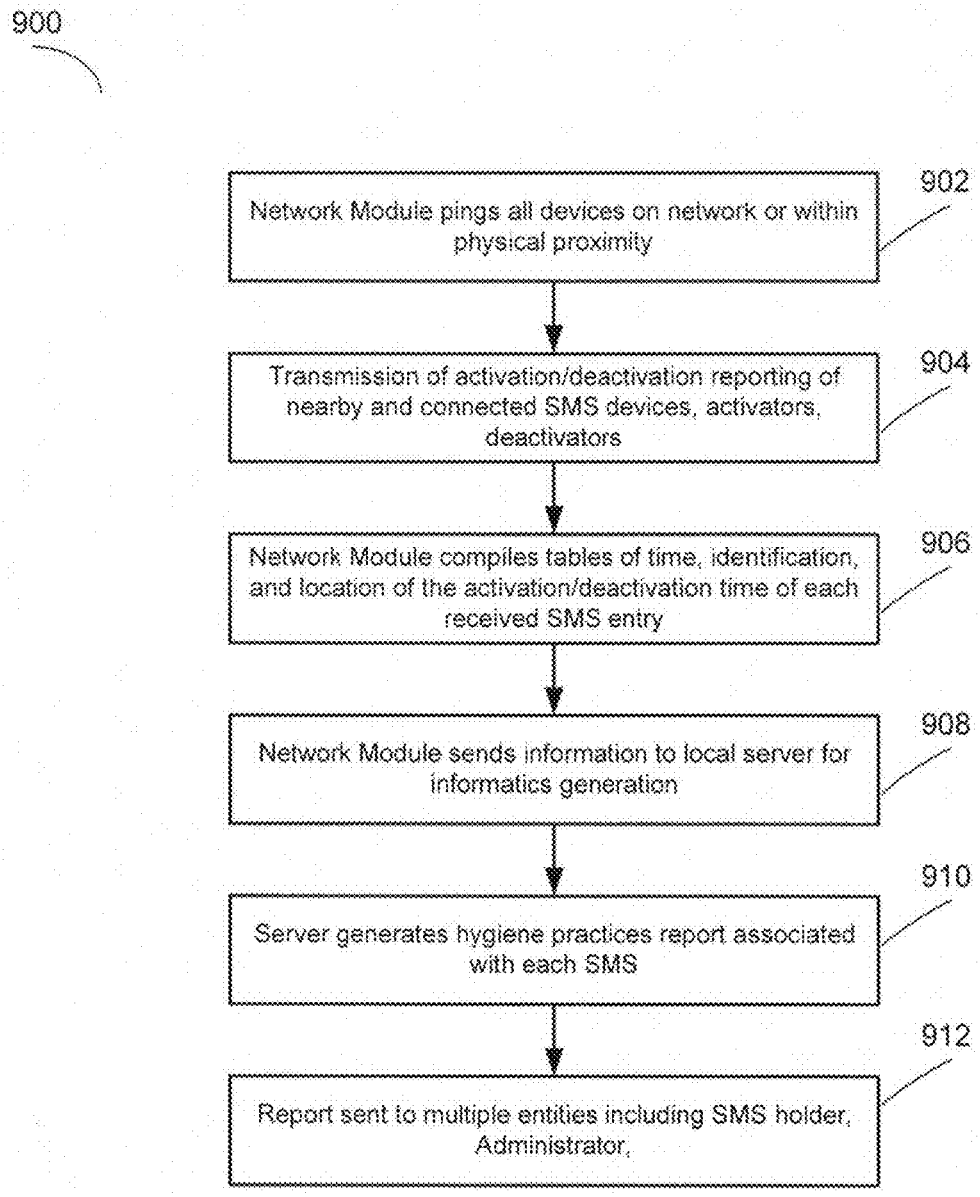
FIG. 9 is a flow diagram of an implementation of activation/deactivation reporting mechanism according to one embodiment.

FIG. 9 is a flow diagram of an exemplary implementation of activation/deactivation reporting mechanism according to one exemplary embodiment 900. In one example, central network module pings 902 all devices on the network or within physical proximity to the central network module to transmit log files of information related to activation/deactivation information, times, locations, and duration of states, prevented access parameters, etc. After being pinged, all devices, including SMS devices, activators, and deactivators that are connected to the network or in close proximity transmit 904 activation/deactivation reports. Thereafter, central network module compiles 906 tables of time; identification and location of the activation/deactivation time of each received entry and sends 908 the information to a local or remote server or database to generate personnel informatics. The server may be connected to a computing device that may generate 910 hygiene practices report associated with each SMS device, hygiene habits, incentives, and recommendations. The generated reports may be sent 912 to multiple entities for analysis or action to be taken, including SMS device holder, hospital or hygiene administrator and staff.

Figure 10:
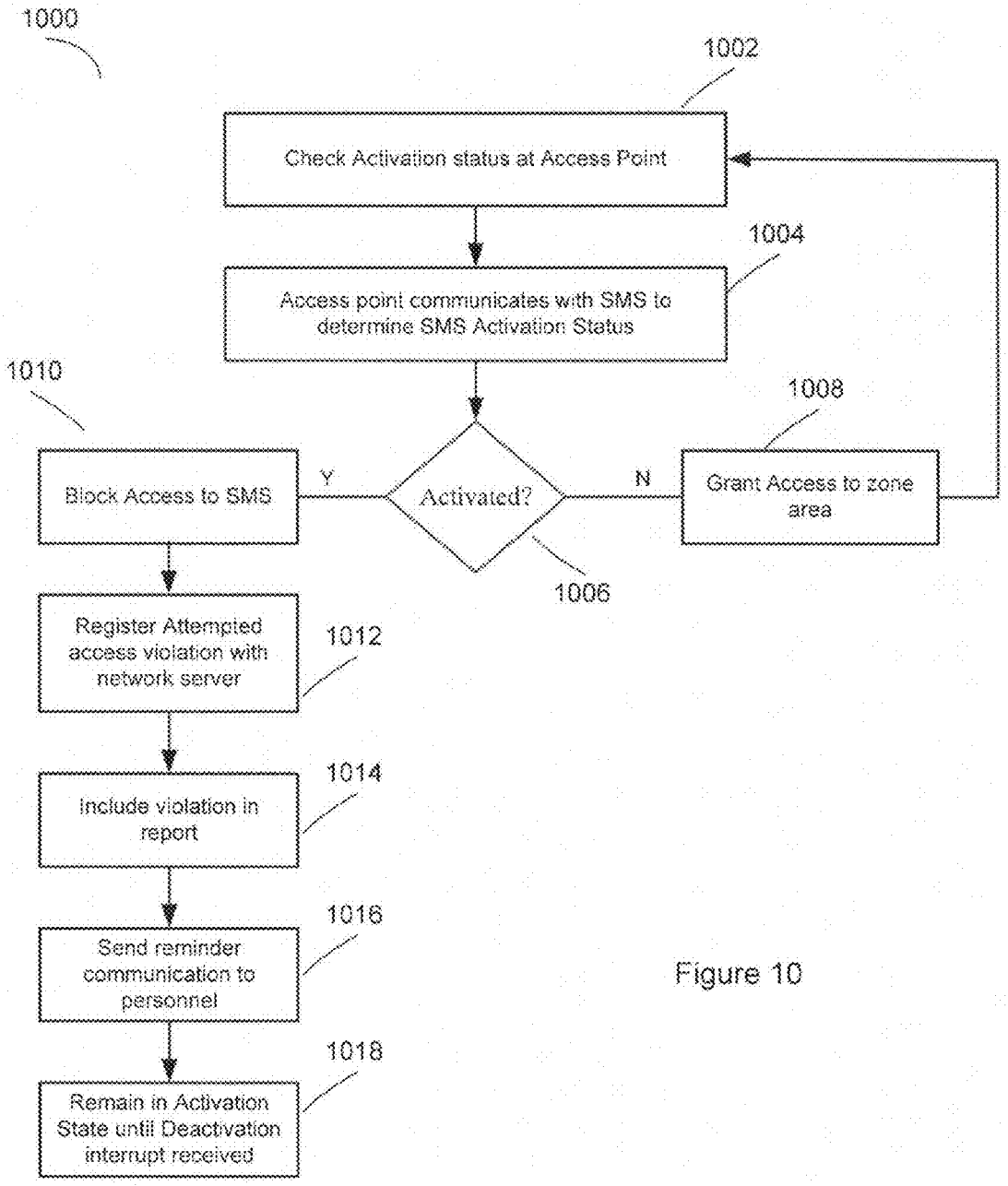
FIG. 10 is a flow diagram of an implementation of access point restrictions determined on an access point level.

FIG. 10 is a flow diagram of an exemplary implementation of access point restrictions determined on an access point level 1000. The system may check 1002 activation status at an access point. The access point communicates with the SMS device to determine SMS device activation status. This can be done via a hand shake mechanism in which SMS device broadcasts its activation status automatically, or if quarried by access terminal. The access terminal determines 1006 whether SMS device is activated or not. If it is not activated, then access terminal may grant access 1008 to a given restricted area or zone, and return to a check activation status mode for the next SMS device. If SMS device is activated, then access terminal may block 1010 access to SMS device. Thereafter, access terminal registers 1012 attempted access violation with network server and database, generate 1014 a violation report and send a reminder communication 1016 to personnel to deactivate their SMS device. The reminder can be a SMS device vibration, a beeper message, a text message, email or any other notification necessary to prompt the personnel to take immediate action. SMS device will remain 1018 in activation state until a deactivation interrupt is received.

Figure 11:
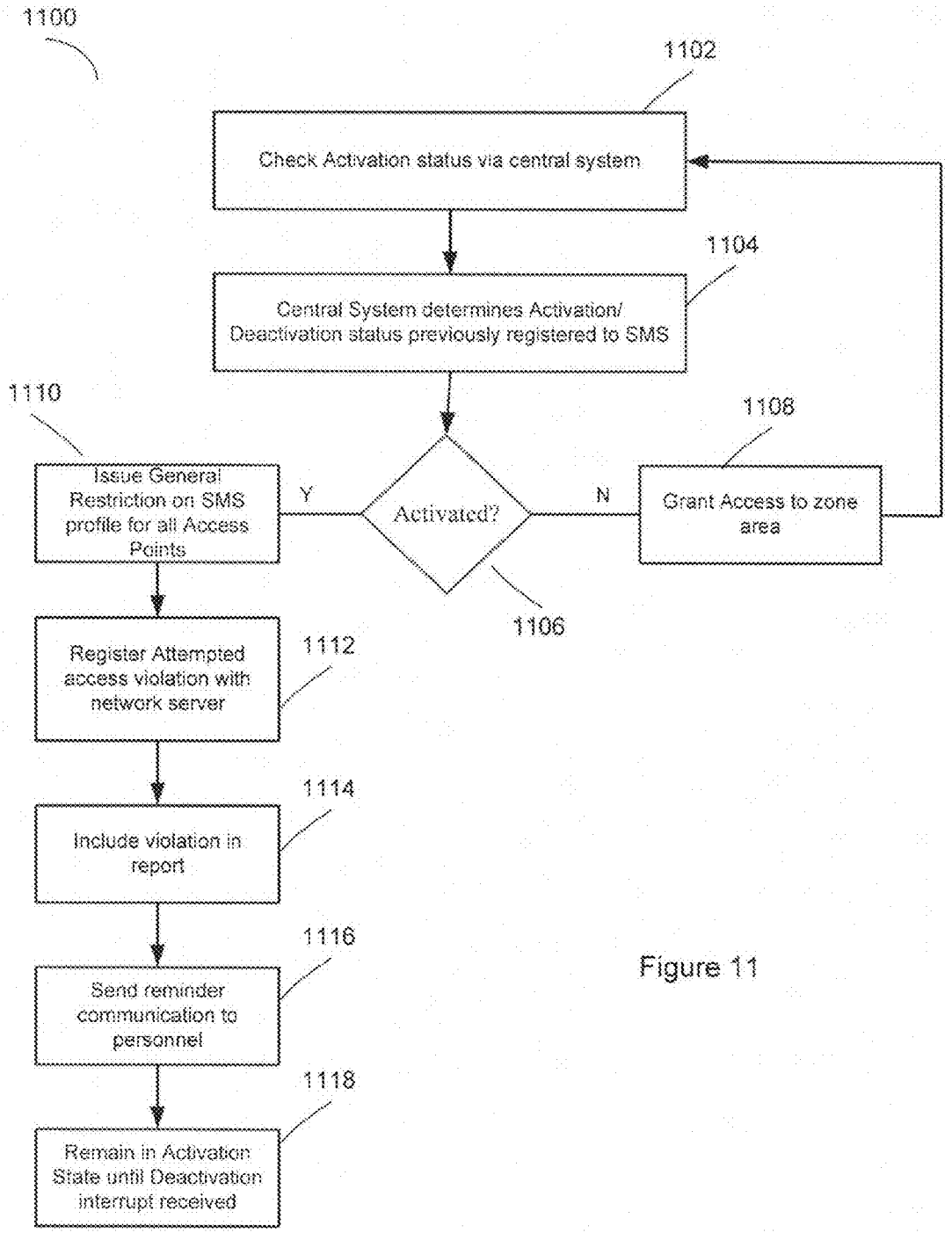
FIG. 11 is a flow diagram of an implementation of access point restrictions determined on a network level.

FIG. 11 is a flow diagram of an exemplary implementation of access point restrictions determined on a network level 1100. The system may check 1102 activation status at the central network module or any other centralized module that monitors the activation/deactivation status of SMS devices. The central system determines 1104 activation/deactivation status previously registered to the SMS device. This may be done in several ways. In one example, access point may quarry the central system for activation status. In another example, central system may block access credentials at each point of determination that SMS device has been activated. Central system may determine SMS activation status via previously generated reports, SMS device response to central system pings for status, automatic uploads from SMS device to central system or the like. The central system determines 1106 whether SMS device is activated or not. If it is not activated, then access terminal may grant access 1108 to a given restricted area or zone, and return to a check activation status mode for the next SMS device. If SMS device is activated, then access terminal may block 1110 access to SMS device. Thereafter, access terminal registers 1112 attempted access violation with network server and database, generate 1114 a violation report and send a reminder communication 1116 to personnel to deactivate their SMS device. The reminder can be a SMS device vibration, a beeper message, a text message, email or any other notification necessary to prompt the personnel to take immediate action. SMS device will remain 1118 in activation state until a deactivation interrupt is received.

In one embodiment, there is described a method for monitoring hand sanitization policy compliance including initializing a sanitization monitoring sensor (SMS) to a deactivated state, the SMS being configured to wearable by a user, activating the SMS by an SMS activator that is disposed in at least one predetermined location of a structure, wherein the SMS is activated upon a determination of at least one of low hand sanitization or contamination, geographic location of the user and a predetermined duration has elapsed since a last sanitization activity, deactivating the SMS by an SMS deactivator configured to deactivate the SMS upon use of an associated sanitization dispenser by the user, monitoring SMS activation/deactivation activity by a network integrated SMS monitoring module, wherein when the SMS changes activation states, the network integrated SMS monitoring module receives a log of SMS activities, including credentials and time of activation/deactivation, and negotiating access credentials by the SMS with at least one access point wherein the access point restricts access to the SMS if the SMS is activated.

The method may further include deactivating the SMS by a touch sensor integrated within the SMS such that when a sanitized finger of the user touches the sensor, the sensor deactivates the SMS. Initializing the SMS includes detecting a motion of the SMS after the SMS has been stationary for a predetermined period of time.

In another embodiment, the initializing includes physically turning on the SMS to a deactivated state. Furthermore, the determination further includes a handshake procedure between the SMS and the SMS activator, such that the SMS activator is configured to transmit a broadcast wakeup signal within its vicinity and upon receiving a wakeup signal, the SMS transmits an activation status signal to the SMS activator. Upon receiving the SMS status signal, the SMS activator transmits an activation signal so as to activate the SMS. Furthermore, upon activation, the method includes illuminating a light emitting diode (LED) integrated within the SMS into one of two states, BLINKING LED or ON LED. Additionally, the BLINKING LED state indicates a medium contamination level that causes a warning signal to be transmitted by the SMS activator, or the network integrated SMS monitoring module, wherein the warning signal is transmitted in a format including vibration, sound, text message, or email. Alternatively, the ON LED state indicates a high contamination level that causes a warning signal to be transmitted to the SMS and further causes a restriction of access credentials of the SMS such that access to the SMS at access points is denied.

In yet another embodiment, the method includes implementing a zone wide activation scheme that the SMS entering into or out of is automatically activated and/or implementing a sub-zone activation scheme that the SMS entering into or out of a specific zone is activated until the SMS is within proximity of a predetermined point of interest. The negotiating access credentials further includes requesting activation status at the at least one access point, receiving a confirmation signal of activation of the SMS, determining access credentials at the at least one access point, wherein the at least one access point is configured to restrict access to the SMS if the SMS is activated, and wherein the at least one access point is further configured to grant access to the SMS if the SMS is deactivated, and reinitializing the at least one access point to check activation status of a new SMS. The at least one access point is operatively connected to the network integrated SMS monitoring module such that upon restricting access of the SMS, an incident report is transmitted from the at least one access point to the SMS monitoring module indicating time and place and identification of the SMS and status of the restricted access. The method further includes wherein upon receiving the incident report, the network integrated SMS monitoring module registers an attempted access violation in a network database, wherein the network database generates a periodic incentive report detailing the activation and deactivation incidences of the SMS, sanitization habits, suggested improvements, and award incentives for high sanitization habits.

In yet another embodiment, the SMS deactivator is further configured to be installed within a sanitization dispenser, such that when the sanitization dispenser is activated, SMS deactivator issues a deactivation signal to the SMS. Furthermore, SMS deactivator is mechanically powered by a mechanical power generator operatively configured to generate power when a lever of the sanitization dispenser is mechanically actuated. Additionally, the SMS deactivator is electrically connected to sanitization dispenser, such that in response to an occurrence of a sanitization activity, the SMS deactivator automatically transmits a deactivation signal to the SMS. Additionally, the SMS deactivator is further configured to transmit short distance deactivation broadcast signals to deactivate the SMS associated with the personnel using the sanitization dispenser and avoid deactivating other SMSs.

In yet another embodiment, there exists a system for monitoring hand sanitization policy compliance includes a sanitization monitoring sensor (SMS) configured to be wearable by a user and further configured to be initialized to a deactivated state, said SMS having a transceiver configured to transmit and receive SMS activation commands and status information stored on a microcontroller integrated within the SMS and configured to store SMS activation commands and status information and further configured to control an indicia integrated within the SMS, such that the indicia indicates at least three activation level signals, an SMS activator operatively configured be disposed in at least one predetermined location of a structure such as to communicate with the SMS when the SMS is within a predetermined proximity, and further configured to activate the SMS upon a determination of any of at least one of predetermined location of a structure, wherein the SMS is activated upon a determination of at least one of low hand sanitization or contamination, geographic location of the user and a predetermined duration has elapsed since a last sanitization activity, an SMS deactivator configured to deactivate the SMS upon use of an associated sanitization dispenser by the user, a network integrated SMS monitoring module configured to monitor the SMS, wherein when the SMS changes activation states, the network integrated SMS monitoring module receives a log of SMS activity, including credentials and time of activation/deactivation, and at least one access point configured to negotiate access credentials with the SMS wherein the access point is configured to restrict to the SMS if the SMS is activated. The SMS further includes an integrated touch sensor configured to deactivate the SMS when a sanitized finger of the user touches the sensor.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

Figure 12:
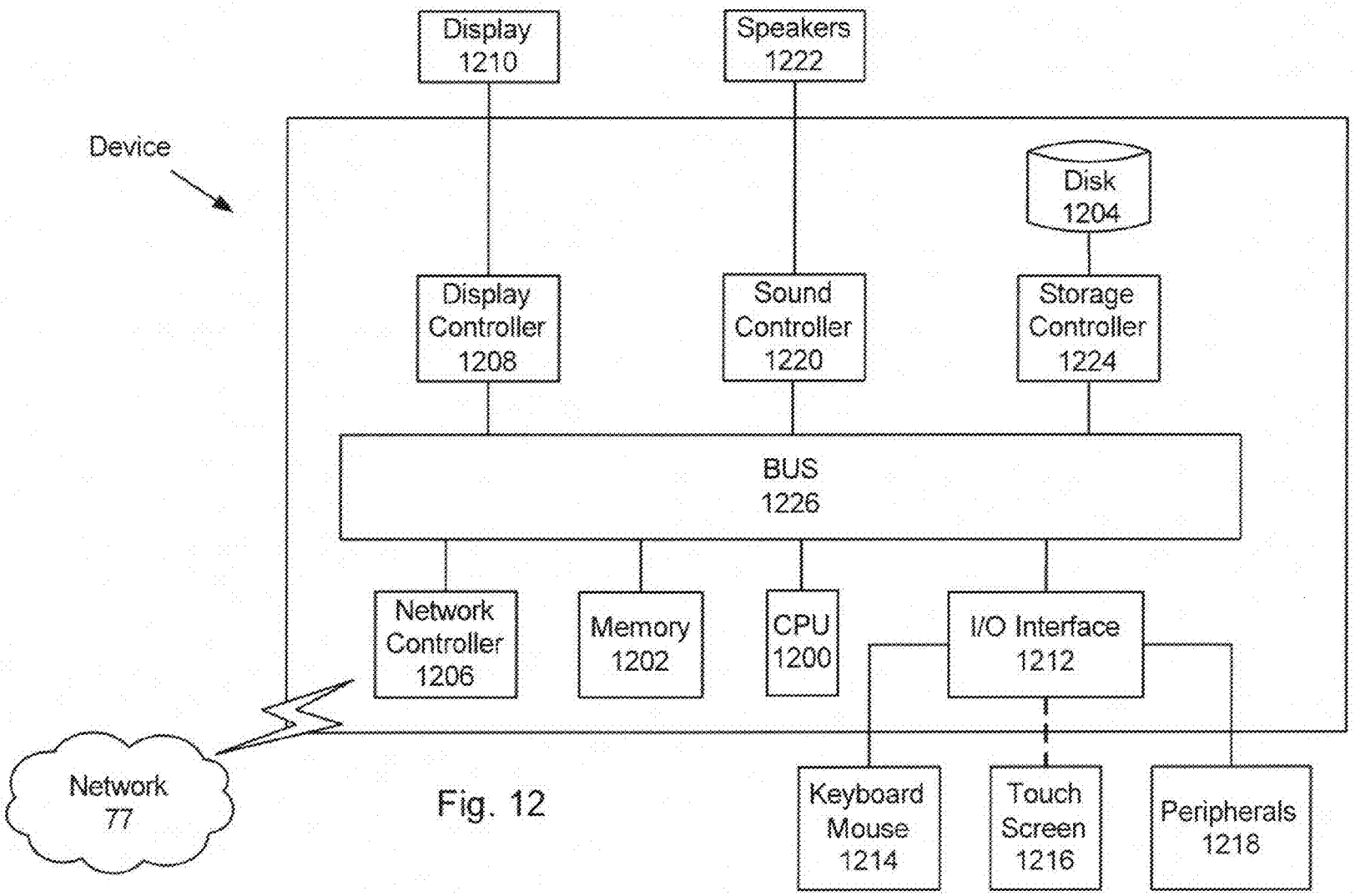
FIG. 12 is an illustration of a hardware description of a device according to embodiments illustrated in FIGS. 1-11.

Next, a hardware description of a device according to exemplary embodiments illustrated in FIGS. 1-11 is described with reference to FIG. 12. In FIG. 12, the device includes a CPU 1200 which performs the processes described above. The process data and instructions may be stored in memory 1202. These processes and instructions may also be stored on a storage medium disk 1204 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the device communicates, such as a server or computer.

Further, the claimed advancements may be provided as a utility application, background daemon, or component of an operating system, or combination thereof, executing in conjunction with CPU 1200 and an operating system such as Microsoft Windows 7, UNIX, Solaris, LINUX, Apple MAC-OS and other systems known to those skilled in the art.

CPU 1200 may be a Xenon or Core processor from Intel of America or an Opteron processor from AMD of America, or may be other processor types that would be recognized by one of ordinary skill in the art. Alternatively, the CPU 1200 may be implemented on an FPGA, ASIC, PLD or using discrete logic circuits, as one of ordinary skill in the art would recognize. Further, CPU 1200 may be implemented as multiple processors cooperatively working in parallel to perform the instructions of the inventive processes described above.

The device in FIG. 12 also includes a network controller 1206, such as an Intel Ethernet PRO network interface card from Intel Corporation of America, for interfacing with network 77. As can be appreciated, the network 77 can be a public network, such as the Internet, or a private network such as an LAN or WAN network, or any combination thereof and can also include PSTN or ISDN sub-networks. The network 77 can also be wired, such as an Ethernet network, or can be wireless such as a cellular network including EDGE, 3G and 4G wireless cellular systems. The wireless network can also be Wi-Fi, Bluetooth, or any other wireless form of communication that is known.

The device further includes a display controller 1208, such as a NVIDIA GeForce GTX or Quadro graphics adaptor from NVIDIA Corporation of America for interfacing with display 1210, such as a Hewlett Packard HPL2445w LCD monitor. A general purpose I/O interface 1212 interfaces with a keyboard and/or mouse 1214 as well as a touch screen panel 1216 on or separate from display 1210. General purpose I/O interface also connects to a variety of peripherals 1218 including printers and scanners, such as an OfficeJet or DeskJet from Hewlett Packard.

A sound controller 1220 is also provided in the device, such as Sound Blaster X-Fi Titanium from Creative, to interface with speakers/microphone 1222 thereby providing sounds and/or music.

The general purpose storage controller 1224 connects the storage medium disk 1204 with communication bus 1226, which may be an ISA, EISA, VESA, PCI, or similar, for interconnecting all of the components of the device. A description of the general features and functionality of the display 1210, keyboard and/or mouse 1214, as well as the display controller 1208, storage controller 1224, network controller 1206, sound controller 1220, and general purpose I/O interface 1212 is omitted herein for brevity as these features are known.

The invention claimed is:

1. A method for monitoring hand sanitization policy compliance comprising:

initializing a sanitization monitoring sensor (SMS) to a deactivated state, the SMS being configured to be wearable by a user;

activating the SMS by an SMS activator that is disposed in a predetermined location of a structure, wherein the SMS is activated upon a determination of at least one of a low hand sanitization condition or a contamination condition, a geographic location of the user, and a predetermined duration has elapsed since a last sanitization activity;

deactivating the SMS by an SMS deactivator configured to deactivate the SMS upon use of an associated sanitization dispenser by the user;

monitoring SMS activation/deactivation activity by a network integrated SMS monitoring module, wherein when the SMS changes activation states, the network integrated SMS monitoring module receives a log of SMS activities, including credentials and time of activation/deactivation;

negotiating access credentials by the SMS with at least one access point wherein the access point restricts access to the SMS if the SMS is activated; and illuminating a light emitting diode (LED) integrated within the SMS into an ON LED state, wherein the ON LED state indicates a high contamination level that causes a warning signal to be transmitted to the SMS and further causes a restriction of access credentials of the SMS such that access to the SMS at the at least one access point is denied.

2. The method of claim 1, further comprising deactivating the SMS by activating a touch sensor integrated within the SMS such that when a sanitized finger of the user touches the sensor, the sensor deactivates the SMS.

3. The method of claim 1, wherein the initializing includes detecting a motion of the SMS after the SMS has been stationary for a predetermined period of time.

4. The method of claim 1, wherein the initializing includes physically setting the SMS to a deactivated state.

5. The method of claim 1, wherein the determination further comprises a handshake procedure between the SMS and the SMS activator, such that the SMS activator is configured to transmit a broadcast wakeup signal within its vicinity, and upon receiving a wakeup signal, the SMS transmits an activation status signal to the SMS activator.

6. The method of claim 5, wherein upon receiving the SMS activation status signal, the SMS activator transmits an activation signal so as to activate the SMS.

7. The method of claim 1, further comprising illuminating a light emitting diode (LED) integrated within the SMS into a BLINKING LED state.

8. The method of claim 7, wherein the BLINKING LED state indicates a medium contamination level that causes a warning signal to be transmitted by the SMS activator, or the network integrated SMS monitoring module, wherein the warning signal includes a vibration, sound, text message, or email.

9. The method of claim 1, further comprising implementing a zone wide activation that causes the SMS when entering into or out of the zone to automatically activate.

10. The method of claim 1, further comprising implementing sub-zone activation that causes the SMS entering into or out of a predetermined sub-zone to automatically activate when the SMS is within proximity of a predetermined point of interest.

11. The method of claim 1, wherein the negotiating access credentials further comprises:

requesting activation status at the at least one access point;

receiving a confirmation signal of activation of the SMS;

determining access credentials at the at least one access point, wherein the at least one access point is configured to restrict access to the SMS if the SMS is activated, the at least one access point is further configured to grant access to the SMS if the SMS is deactivated; and reinitializing the at least one access point to check activation status of a new SMS.

12. The method of claim 9, wherein the at least one access point is operatively connected to the network integrated SMS monitoring module such that upon restricting access of the SMS, an incident report is transmitted from the at least one access point to the SMS monitoring module indicating time and place and identification of the SMS and status of the restricted access.

13. The method of claim 12, wherein upon receiving the incident report, the network integrated SMS monitoring module registers an attempted access violation in a network database, wherein the network database generates a periodic incentive report detailing activation and deactivation incidences of the SMS, sanitization habits, suggested improvements, and award incentives for high sanitization habits.

14. The method of claim 1, wherein the SMS deactivator is further configured to be installed within a sanitization dispenser, such that when the sanitization dispenser is activated, the SMS deactivator issues a deactivation signal to the SMS.

15. The method of claim 12, wherein SMS deactivator is mechanically powered by a mechanical power generator operatively configured to generate power when a lever of the sanitization dispenser is mechanically actuated.

16. The method of claim 12, wherein the SMS deactivator is electrically connected to the associated sanitization dispenser, such that in response to an occurrence of a sanitization activity, the SMS deactivator automatically transmits a deactivation signal to the SMS.

17. The method of claim 12, wherein the SMS deactivator is further configured to transmit a short distance deactivation broadcast signal to deactivate the SMS associated with the personnel using the sanitization dispenser and avoid deactivating other SMSs.

18. A system for monitoring hand sanitization policy compliance comprising:

a sanitization monitoring sensor (SMS) configured to be wearable by a user and further configured to be initialized to a deactivated state, said SMS having a transceiver configured to transmit and receive SMS activation commands and status information stored on a microcontroller integrated within the SMS and configured to store SMS activation commands and status information and further configured to control an indicia integrated within the SMS, such that the indicia indicates at least three activation level signals;

an SMS activator operatively configured be disposed in at least one predetermined location of a structure such as to communicate with the SMS when the SMS is within a predetermined proximity, and further configured to activate the SMS upon a determination of a predetermined location of a structure, wherein the SMS is activated upon a determination of at least one of a low hand sanitization condition or a contamination condition, or a geographic location of the user, and a predetermined duration has elapsed since a last sanitization activity;

an SMS deactivator configured to deactivate the SMS upon use of an associated sanitization dispenser by the user;

a network integrated SMS monitoring module configured to monitor the SMS, wherein when the SMS changes activation states, the network integrated SMS monitoring module receives a log of SMS activity, including credentials and time of activation/deactivation;

at least one access point configured to negotiate access credentials with the SMS wherein the access point is configured to restrict to the SMS if the SMS is activated; and a light emitting diode (LED) integrated within the SMS and configured to be illuminated into an ON LED state, wherein the ON LED state indicates a high contamination level that causes a warning signal to be transmitted to the SMS and further causes a restriction of access credentials of the SMS such that access to the SMS at the at least one access point is denied.

19. The system of claim 18, wherein the SMS further comprises an integrated touch sensor configured to deactivate the SMS when a sanitized finger of the user touches the integrated touch sensor.

20. A system for monitoring hand sanitization policy compliance comprising:

a sanitization monitoring sensor (SMS) configured to be wearable by a user and further configured to be initialized to a deactivated state, said SMS having a transceiver configured to transmit and receive SMS activation commands and status information stored on a microcontroller integrated within the SMS and configured to store SMS activation commands and status information and further configured to control an indicia integrated within the SMS, such that the indicia indicates at least three activation level signals;

an SMS activator operatively configured be disposed in at least one predetermined location of a structure such as to communicate with the SMS when the SMS is within a predetermined proximity, and further configured to activate the SMS upon a determination of a predetermined location of a structure, wherein the SMS is activated upon a determination of at least one of a low hand sanitization condition or a contamination condition, or a geographic location of the user, and a predetermined duration has elapsed since a last sanitization activity;

an SMS deactivator configured to deactivate the SMS upon use of an associated sanitization dispenser by the user;

a network integrated SMS monitoring module configured to monitor the SMS, wherein when the SMS changes activation states, the network integrated SMS monitoring module receives a log of SMS activity, including credentials and time of activation/deactivation;

at least one access point configured to negotiate access credentials with the SMS wherein the access point is configured to restrict to the SMS if the SMS is activated; and a light emitting diode (LED) integrated within the SMS and configured to be illuminated into a BLINKING LED state, wherein the BLINKING LED state indicates a medium contamination level that causes a warning signal to be transmitted by the SMS activator, or the network integrated SMS monitoring module, wherein the warning signal includes a vibration, sound, text message, or email.

* * * * *